US008980439B2

(12) United States Patent
Carlson et al.

(10) Patent No.: US 8,980,439 B2
(45) Date of Patent: Mar. 17, 2015

(54) BIMETALLIC FORGING AND METHOD

(75) Inventors: Blair E. Carlson, Ann Arbor, MI (US); Paul E. Krajewski, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 672 days.

(21) Appl. No.: 12/902,361

(22) Filed: Oct. 12, 2010

(65) Prior Publication Data

US 2012/0088116 A1 Apr. 12, 2012

(51) Int. Cl.
*B21K 1/28* (2006.01)
*B21J 1/00* (2006.01)

(52) U.S. Cl.
CPC ... *B21K 1/28* (2013.01); *B21J 1/003* (2013.01)
USPC ..... 428/579; 72/362

(58) Field of Classification Search
CPC ..... B21K 25/00; B21K 1/28; B21K 1/29; B21K 1/32; B65D 7/02; B65D 2543/00425
See application file for complete search history.

(56) References Cited

U.S. PATENT DOCUMENTS 2,100,257 A * 11/1937 Larson ..... 428/649
3,007,603 A * 11/1961 Krehl ..... 220/618
3,179,504 A * 4/1965 Bothwell ..... 428/649
4,838,936 A * 6/1989 Akechi ..... 75/249
6,913,840 B2 * 7/2005 Nishikawa et al. ..... 428/649
2007/0193102 A1 * 8/2007 Briggs ..... 42/76.02

FOREIGN PATENT DOCUMENTS

EP 0126930 A1 12/1984
EP 2371579 A1 * 10/2011
WO 2010017879 A1 2/2010
WO 2010067626 A1 6/2010
WO WO 2010067626 A1 * 6/2010

OTHER PUBLICATIONS http://lsxtv.com/forum/40-years-racing-heritage-ferrea-1241.html, printed Jun. 22, 2010.

* cited by examiner

*Primary Examiner* — Adam Krupicka
(74) *Attorney, Agent, or Firm* — Quinn Law Group, PLLC

(57) ABSTRACT

A method of forming a bimetallic forging includes providing a blank comprising at least a first element and a second element of a first metal, and an insert of a second metal. A blank is configured such that the insert may be substantially encapsulated by a shell defined by the first element and the second element. The blank is forged to form a bimetallic forging including an outer portion defined by the shell, an inner portion defined by the insert, and an interface layer therebetween. In a non-limiting example, the first metal is substantially comprised of aluminum and the second metal is substantially comprised of magnesium. In a non-limiting example, the blank may be forged to form a vehicle wheel including an aluminum skin substantially encapsulating a magnesium inner portion, providing wheel with a high strength to weight ratio and improved corrosion performance.

16 Claims, 2 Drawing Sheets

BIMETALLIC FORGING AND METHOD

TECHNICAL FIELD

The present invention relates to forming a bimetallic forging and method.

BACKGROUND

Components formed of magnesium offer advantages such as high strength to weight ratio when compared to similarly sized components formed of aluminum or ferrous based materials. For example, wheels have been forged from magnesium for specialized applications such as racing vehicle wheels. The use of magnesium wheels for non-specialty vehicles has been limited by the poor corrosion performance of magnesium. Coatings applied to the surface of magnesium components, for example, aluminum diffusion or diffused aluminum coatings, to improve the corrosion performance of the magnesium, have been developed, however spalling and chipping of applied coatings negates the protective effect of the coating. The material, processing time, equipment, handling and transportation and associated costs required for applying coatings in a secondary process such as aluminum diffusion or diffused aluminum coatings to magnesium components represent time and cost disadvantages.

SUMMARY

A method of forming a bimetallic forging is provided. The method includes providing a first element substantially made of a first metal, a second element substantially made of the first metal, and an insert substantially made of a second metal. A blank is formed comprising the first element, the second element, and the insert. The blank is configured such that the insert may be substantially encapsulated by a shell defined by the first element and the second element. The first element and the second element may be operatively joined to further define the shell. The blank is forged to form a bimetallic forging. The bimetallic forging includes an outer portion defined by the shell, an inner portion defined by the insert, and an interface layer between the inner portion and the outer portion. In a non-limiting example, the first metal is aluminum or an aluminum alloy and the second metal is magnesium or a magnesium alloy. The blank is configurable, in a non-limiting example, to be formed by forging into a wheel for use on a vehicle and configured such that the aluminum outer portion substantially encapsulates the magnesium inner portion, thereby providing a forging with a high strength to weight ratio, and an exterior skin of aluminum for improved corrosion performance.

A blank configurable for forming by forging is provided. The blank includes a first element, substantially made of a first metal, a second element substantially made of the first metal, and an insert substantially made of a second metal. The first element and the second element are configured in proximate contact with each other and the insert, such that the first element and the second element define a shell which substantially encapsulates the insert. The first element and the second element may be operatively joined to define the shell. In a non-limiting example, the first metal is substantially comprised of aluminum or an aluminum alloy, and the second metal is substantially comprised of magnesium or a magnesium alloy. The blank may further include a third element in proximate contact with the insert and at least one of the first element and the second element such that the first element, the second element and the third element define the shell which substantially encapsulates the insert. The insert may be configured as a casting. At least one of the first element and the second element may be configured as a casting or an extrusion. The shell and the insert may be configured such that the shell is non-concentric with the insert, or the shell may be of a non-uniform thickness, such that the outer portion of the forging defined thereby may be of non-uniform thickness to provide, for example, supplementary material in some areas of the forging, for example, to improve the strength of the outer portion in those areas, or to provide supplementary stock for secondary finishing operations such as machining or surface finishing treatments.

A bimetallic forging formed from a blank is provided. The bimetallic forging comprises an outer portion substantially made of a first metal and defined by a shell portion of the blank, an inner portion substantially made of a second metal and defined by an insert portion of the blank, and an interface layer defining a metallurgical bond between the outer portion and the inner portion. In a non-limiting example, the first metal may be aluminum or an aluminum alloy, and the second metal may be magnesium or a magnesium alloy. The interface layer may be defined by an intermetallic layer comprising at least the first metal and the second metal. The forging may be configured such that the outer portion substantially encapsulates the inner portion. In a non-limiting example, the bimetallic forging may be configured as a wheel for a vehicle.

The above features and other features and advantages of the present invention are readily apparent from the following detailed description of the best modes for carrying out the invention when taken in connection with the accompanying drawings.

DETAILED DESCRIPTION

Figure 1:
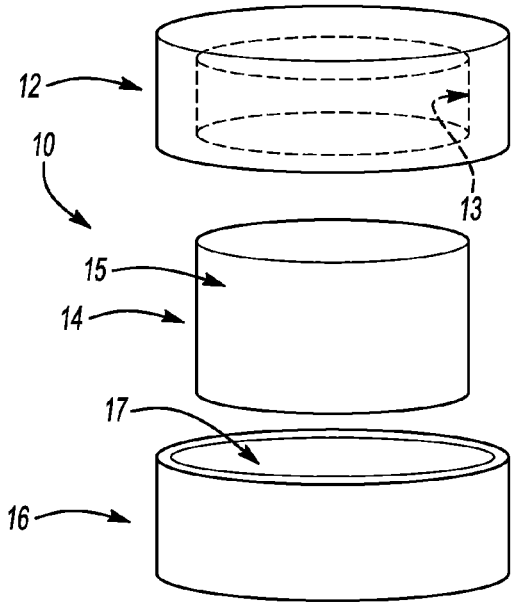
FIG. 1 is a schematic perspective exploded view of a bimetallic blank.

Referring to the drawings wherein like reference numbers represent like components throughout the several figures, the elements shown in FIGS. 1-7B may not be to scale or proportion. Accordingly, the particular dimensions and applications provided in the drawings presented herein are not to be considered limiting.

FIG. 1 shows an exploded view of a blank 10, which may also be referred to as a blank assembly or a forging blank, where the blank 10 is configurable for forming by forging. The blank 10 is comprised of a first element 12 substantially made of a first metal, a second element 16 substantially made of the first metal, and an insert 14 substantially made of a second metal. In a non-limiting example, the first metal may be substantially comprised of aluminum, an aluminum alloy or a material of predominantly aluminum composition and the second metal may be substantially comprised of magnesium, a magnesium alloy or a material of predominantly magnesium composition.

The first element 12, which may also be referred to as a first casing element, defines a surface 13, which is generally configured as the interior or inner surface 13 of the first element 12. The surface 13 defines a cavity or opening in first element 12. The second element 16, which may also be referred to as a second casing element, defines a surface 17, which is generally configured as the interior or inner surface 17 of the second element 16. The surface 17 defines a cavity or opening in element 16. The first and second elements 12, 16 may be, but are not required to be, similarly configured. The first and second elements 12, 16 may be configured, by way of non-limiting example, as a casting, forging or extrusion, and may be further configured by secondary processing including but not limited to additional forming, machining, heat treating, or surface treatment operations.

The insert 14 defines a surface 15, which is generally configured as the exterior or outer surface 15 of the insert 14. The insert 14 may be configured, by way of non-limiting example, as a casting, forging or extrusion, which may be further configured by secondary processing including but not limited to additional forming, machining, heat treating, or surface treatment operations.

Figure 2:
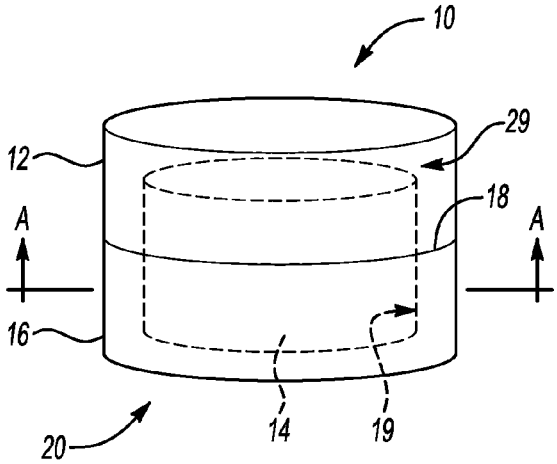
FIG. 2 is a schematic perspective illustration of the blank of FIG. 1.

In the non-limiting example shown in FIGS. 1 and 2, the first and second elements 12, 16 are configured as generally cylindrical elements, each having one enclosed end and a cavity defined by a respective inner surface 13, 17. The insert 14 is configured generally as a substantially solid cylinder, such that the insert 14 can be inserted into the generally cylindrical cavities defined by inner surfaces 13, 17 to form the blank 10. The insert 14 may be inserted into the casings 12, 16 using any suitable method, which may include, by way of non-limiting example, slip-fitting or pressing the insert 14 into the cavities of elements 12, 16 defined by surfaces 13, 17. The surfaces 13, 15, 17 may be configured or modified to facilitate assembly of the blank 10, for example, by tapering the respective surfaces, or by knurling or relieving one or more of the surfaces. One or more of the interfacing surfaces 13, 15, 17 may be lubricated with a coating or lubricant, such as a graphite or boron-nitride coating, to facilitate the assembly of the insert 14 and the elements 12, 16.

A coating substantially comprised of a third metal may be applied to the outer surface 15 of the insert 14, such that during the forging process, the third metal may form an intermetallic or a metal matrix composite with one or both of the first metal and the second metal. The third metal comprising the coating may be, for example, one of silver, tin, zinc, copper or alumina. The coating may be applied to the surface 15 of insert 14, for example, by thermal spraying, cold spraying, plasma spraying or any suitable method. Alternatively, the coating comprising the third metal may be applied to the inner surfaces 13, 17 of elements 12, 16 instead of or in addition to applying the coating to the surface 15 of the insert 14.

FIG. 2 shows the blank 10 formed by operatively assembling the first element 12, the second element 16, and the insert 14, such that the inner surfaces 13, 17 of first and second elements 12, 16, respectively, are in proximate contact with the outer surface 15 of insert 14 to define an interface 19, and such that the first and second elements 12, 16 are in proximate contact to define a joint 18. The joint 18 may be configured as a seam formed by operatively joining the first element 12 and the second element 16 using any method suitable to provide an operative seam or joint which is formable by forging. For example, the first and second elements 12, 16 may be joined by using friction stir welding to form the seam 18, where the friction welding process provides a seam 18 defined by a fine grained microstructure suitable for forming by forging.

The blank 10 may be configured such that the insert 14 may be substantially encapsulated by a shell 20 defined by the first element 12 and the second element 16. The shell 20 may include an outer surface 29. "Substantially encapsulating" the insert 14 with the shell 20 may include configuring the shell 20 to encapsulate all but an insignificant area of the outer surface 15 of the insert 14, such that when blank 10 is forged, the bimetallic forging 30 (see FIGS. 5A and 5B) which is formed from the blank 10 includes an outer or skin portion 32 defined by the shell 20, and an inner or core portion 34 defined by the insert 14. The skin portion 32 of the forging 30 thus formed may substantially encapsulate the core portion 34, such that, in the non-limiting example provided herein, the aluminum comprising the skin portion 32 defines or provides a corrosion protection layer which substantially covers the magnesium comprising the core portion 34, thus limiting the exposure of the magnesium-based material comprising the core portion 34 to corrosive factors and environments, thereby improving the corrosion performance of the forging 30.

Figure 3:
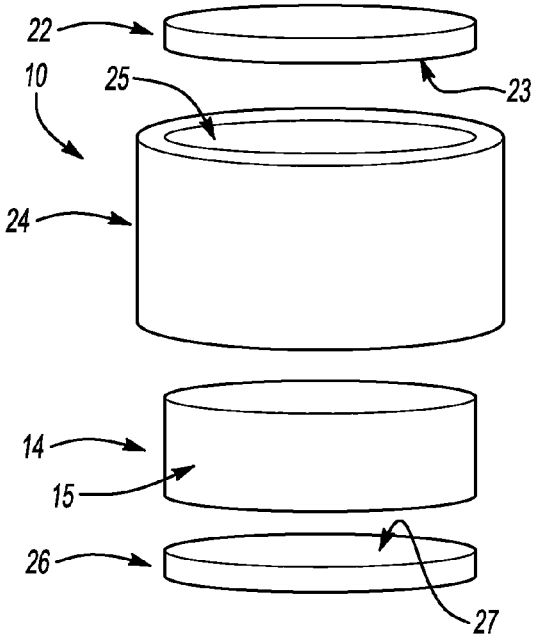
FIG. 3 is a schematic perspective exploded view of an alternate configuration of a bimetallic blank.
Figure 4:
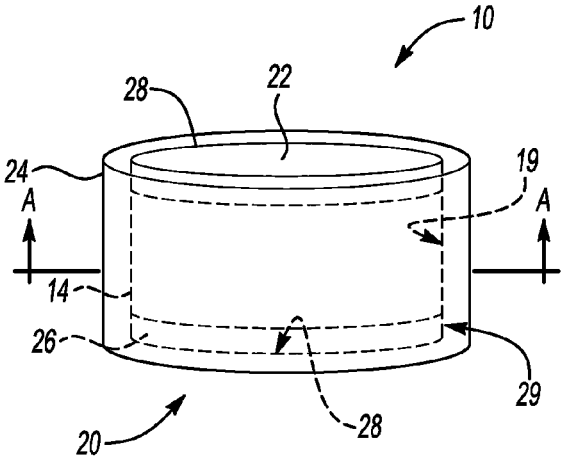
FIG. 4 is a schematic perspective illustration of the blank of FIG. 3.

FIGS. 3 and 4 show an alternate configuration of the blank 10. FIG. 3 shows an exploded view of the blank 10 comprised of a first element 22 substantially made of a first metal, a second element 26 substantially made of the first metal, a third element 24 substantially made of the first metal, and the insert 14 substantially made of a second metal. In a non-limiting example, the first metal may be substantially comprised of aluminum, an aluminum alloy or a material of predominantly aluminum composition, and the second metal may be substantially comprised of magnesium, a magnesium alloy or a material of predominantly magnesium composition.

The first element 22, which may also be referred to as a first casing element, defines a surface 23, which is generally configured as the interior or inner surface 23 of the first element 22. The second element 26, which may also be referred to as a second casing element, defines a surface 27, which is generally configured as the interior or inner surface 27 of the second element 26. The third element 24, which may also be referred to as a third casing element, defines a surface 25, which is generally configured as the interior or inner surface 25 of the third element 24. The surface 25 defines a cavity or opening in element 24. The first and second elements 22, 26 may be, but are not required to be, similarly configured. The first, second and third elements 22, 24, 26 may be configured, by way of non-limiting example, as a casting, forging, stamping or extrusion, which may be subject to secondary processing including additional forming, machining, heat treating, or surface treatment operations.

The insert 14 is defined as described for FIGS. 1 and 2, and defines an outer surface 15. In the non-limiting example shown in FIGS. 3 and 4, the first and second elements 22, 26 are configured as generally cylindrical plates, and the third element 24 is configured generally as a hollow cylinder with the hollow portion of the cylinder defined by the surface 25. The insert 14 is configured generally as a solid cylinder, such that the insert 14 can be inserted or fitted into the generally cylindrical cavity defined by the inner surface 25 of the third element 24. A hollow space or cavity is defined by each end of insert 14 and the adjacent surface 25 after insert 14 has been fitted into the third element 24, such that each of the first and second elements 22, 26 can be fitted into the hollow space at a respective end of the third element 24 and proximate to a respective end of the insert 14 to form the blank 10 shown in FIG. 4. The insert 14 and elements 22, 26 may be fitted into the casing 24 using any suitable method, which may include, by way of non-limiting example, slip-fitting or pressing the insert 14 into the inner space of element 24 defined by surface 25. The interfacing surfaces of elements 22, 24, 26 and insert 14 may be configured or modified to facilitate assembly of the blank 10, for example, by tapering the respective surfaces, or by knurling or relieving one or more of the surfaces. One or more of the interfacing surfaces of elements 22, 24, 26 and insert 14 may be lubricated with a coating or lubricant, such as a graphite or boron-nitride coating, to facilitate the assembly of insert 14 and elements 22, 24 and 26.

In a non-limiting example, a coating substantially comprised of a third metal may be applied to the outer surface 15 of the insert 14, such that during the forging process, the third metal may form an intermetallic or a metal matrix composite with one or both of the first metal and the second metal. The third metal comprising the coating may be, for example, one of silver, tin, zinc, copper or alumina. The coating comprised of the third metal may be applied to the surface 15 of the insert 14, for example, by thermal spraying, cold spraying, plasma spraying or any suitable method. Alternatively, the coating comprising the third metal may be applied to the inner surfaces 23, 25, 27 of elements 22, 24, 26 instead of or in addition to applying the coating to the surface 15 of the insert 14.

FIG. 4 shows the blank 10 formed by operatively assembling the first, second and third elements 22, 26, 24 and the insert 14, such that the inner surfaces 23, 25, 27 of first, second, and third elements 22, 26, 24, respectively, are in proximate contact with the outer surface 15 of insert 14 to define an interface 19. Further, the blank 10 is formed such that the first and second elements 22, 26 are each in proximate contact with the third element 24, and such that a joint 28 is defined between the elements 22 and 24 and another joint 28 is defined between the elements 26 and 24. Each joint 28 may be configured as a seam formed by operatively joining one of the elements 22, 26 and the third element 24 using any method suitable to provide an operative seam or joint which is formable by forging. For example, the first and third elements 22, 24 may be joined by using friction stir welding to form the seam 28, where the friction stir process provides a seam 28 defined by a fine grained microstructure suitable for forming by forging. The blank 10 may be configured such that the insert 14 may be substantially encapsulated by a shell 20 defined by the first, second and third elements 22, 26, and 24, as described for blank 10 related to FIGS. 1 and 2.

Other configurations of a plurality of casing elements are possible, which may define a shell 20 of a first metal which when assembled with an insert 14 of a second metal defines a blank 10, where the shell 20 may be configured to substantially encapsulate the insert 14. Other configurations of casing elements and inserts are possible, some of which are shown in FIGS. 6A-7B in a cross-sectional view taken through insert 10 through a section A-A shown in FIGS. 2 and 4, and described in further detail herein.

Figure 5A:
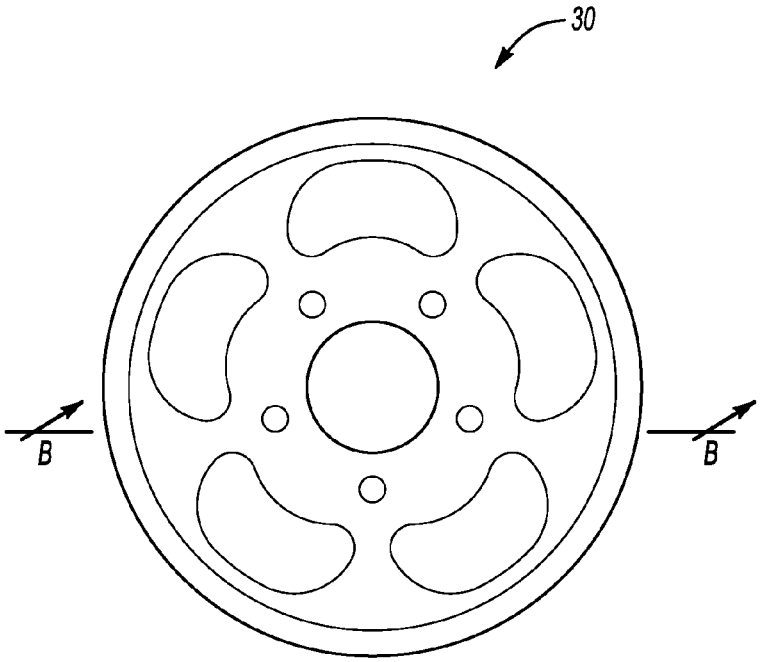
FIG. 5A is a plan view of a forging formed using the blank of FIG. 2 or FIG. 4.
Figure 5B:
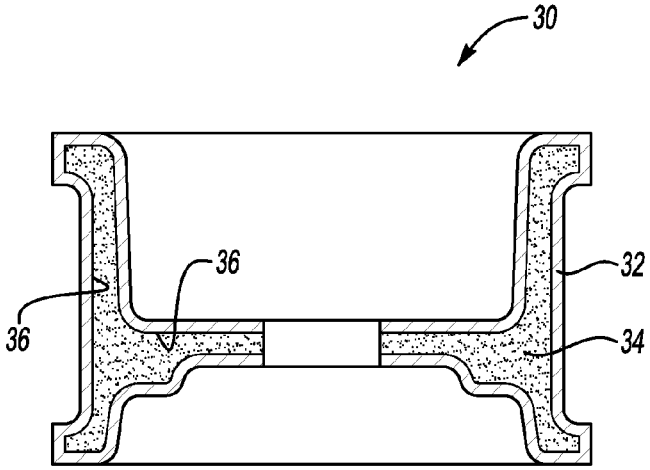
FIG. 5B is a schematic cross-sectional view of the forging of FIG. 5A.

The blank 10 may be forged to form a bimetallic forging 30 shown in FIG. 5A, which in a non-limiting example is configured as a wheel 30 adaptable for use on a vehicle. FIG. 5B shows a cross-sectional schematic view of the forged wheel 30 taken through a section B-B shown in FIG. 5A. The blank 10 may be preheated in preparation for forging, and may be forged into the forging 30 using any suitable forging method, including hammer forging and drop forging. The blank 10 is forged to form the forging 30 including an outer or skin portion 32 defined by the shell 20 of blank 10 and as such substantially comprised of the first metal, an inner or core portion 34 defined by the insert 14 and as such substantially comprised of the second metal, and an interface layer 36 therebetween. The interface layer 36 provides a metallurgical bond between the inner portion 34 and the outer portion 32, and may be further defined by an intermetallic layer comprising the first metal and the second metal.

In an alternative configuration, as discussed previously, a coating substantially comprised of a third metal may be applied to the outer surface 15 of the insert 14, and/or to the inner surfaces of the casing elements, such that during the forging process, the third metal of the coating may form an intermetallic and/or a metal matrix composite with one or both of the first metal and the second metal which defines the interface layer 36. The formation of the intermetallic by diffusion bonding and/or the formation of the metal matrix composite may be activated when the blank is preheated in preparation for forging, or during the forging operation. In a non-limiting example, the third metal comprising the coating may be one of silver, tin, zinc, copper or alumina, and may combine with the magnesium-based material of the insert and/or the aluminum-based material of the casing to form either an intermetallic which is less brittle than a magnesium-aluminum intermetallic such as $Mg_{17}Al_{12}$ which may form in the interface layer 36 during the forging process in the absence of the coating, or to form a metal matrix composite which may improve the mechanical properties of the interface layer 36.

In a non-limiting example provided herein, the first metal is a substantially aluminum-based material and the second metal is a substantially magnesium-based material, and the wheel 30 is formed and configured such that the aluminum outer portion 32 substantially encapsulates the magnesium inner portion 34, thereby providing a forged wheel 30 with a high strength to weight ratio and an exterior skin 32 of aluminum for improved corrosion performance. The aluminum skin portion 32 provides a corrosion protection layer which substantially covers the magnesium comprising the core portion 34, thus limiting the exposure of the magnesium-based material comprising the core portion 34 to corrosive factors and environments, thereby improving the corrosion performance of the wheel 30. Improvement in other performance characteristics of wheel 30, such as thermal shock resistance, may be provided by the bimetallic configuration of wheel 30.

The insert 14 and the shell 20 may be configured such that the insert 14 is non-concentric or non-symmetrical to the shell 20. The shell 20 may be of a non-uniform thickness. The outer portion 32 of the forging 30 defined by a non-uniform or non-symmetrical shell 20 may be of non-uniform thickness to define a thicker skin 32 in some areas of the surface of wheel 30, to provide supplementary material to improve the strength of the outer portion 32 in those areas, or to provide supplementary stock for secondary finishing operations such as machining or surface finishing treatments. For example, a thicker skin 32 may be provided on the outboard or appearance face of the wheel 30, as mounted on the vehicle, or at the rim of the wheel 30, to provide surplus material to form or finish the appearance face of the wheel 30 or to form or finish the bead or tire mounting surface of the rim, and/or to provide additional corrosion protection against nicks, scratches, stone-impingement, road dirt or other corrosive environmental elements in these areas.

The outer portion 32 of the forging 30 may be of non-uniform thickness to define a thinner skin 32 in some areas of the surface of wheel 30, such that the aluminum portion 32 in these areas provides nominal corrosion protection to the magnesium portion 34 of the wheel 30, recognizing aluminum is denser than magnesium, to minimize the weight contribution of the aluminum portion 32 of the wheel 30 to maximize the strength to weight ratio of the wheel 30. For example, a thinner skin 32 may be provided on sections of the wheel 30 which may be substantially covered by a vehicle tire and a hub cap or decorative trim cover, such that these sections may be minimally exposed to the road environment.

The thickness of shell 20 may be varied across the surface of the blank 10 to affect the relative flow characteristics of the aluminum portion 20 and the magnesium portion 14 in the forging die during the forming of forging 30. Further, the material flow during the forging process may be locally varied, e.g., varied in localized areas of the blank 10, by varying the microstructure of the shell 20. For example, certain regions or areas of the shell 20 may be subjected to friction stir processing where increased material flow during forging is desired, resulting in a fine grain structure in the processed areas that will preferentially flow during forging to affect the distribution of the thickness of the skin portion 32 on the forging 30. These areas of fine grain structure may be characterized by increase fatigue resistance.

Figure 6A:
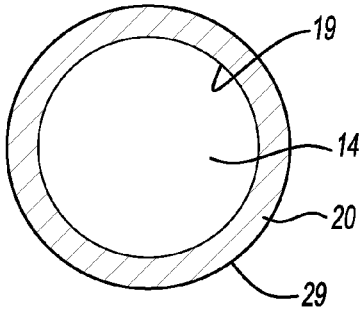
FIG. 6A is a schematic cross-sectional view of the blank of FIG. 2 or FIG. 4.

Multiple configurations of a blank 10 would be possible to provide, for example, varying thickness and distribution of the skin portion 32 over the surface of the core portion 34 of the forging. FIG. 6A shows a cross-sectional view of the blank 20 taken through a section A-A shown in FIGS. 2 and 4. As discussed for FIGS. 1-4, blank 10 is defined by an insert 14, a shell 20, and an interface 19 therebetween. Shell 20 is defined by an outer surface 20. In the non-limiting example shown in FIG. 6A, the cross-section of the insert portion 14 is generally round and is generally concentric with the generally annular cross-section of shell 20, such that the interface 19 and the outer surface 29 are both generally circular and concentric to each other.

Figure 6B:
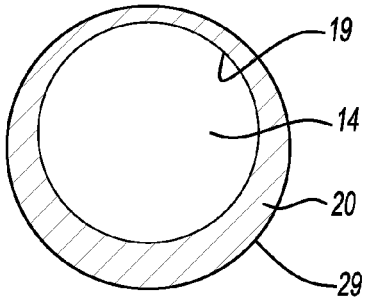
FIG. 6B is a schematic cross-sectional view of an alternate configuration of the blank of FIG. 2 or FIG. 4.

In another configuration shown in FIG. 6B, the shell 20 is defined in the cross-sectional view shown, by a generally circular inner surface forming the interface 19, which is eccentric to the outer surface 29 of the shell 20, thereby providing respectively thinner and thicker areas of the aluminum shell 20. When blank 10 is formed into wheel 30, the thinner and thicker sections of the shell 20 may be deformed during the forging process to provide areas of non-uniform thickness in the skin portion 32 of the resulting forging 30.

Figure 7A:
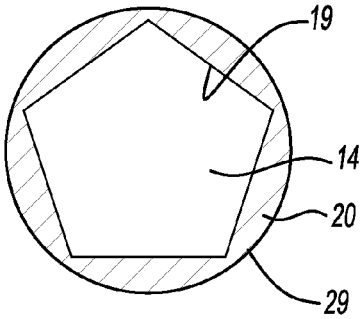
FIG. 7A is a schematic cross-sectional view of an alternate configuration of the blank of FIG. 2 or FIG. 4.
Figure 7B:
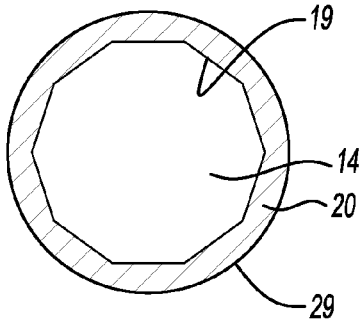
FIG. 7B is a schematic cross-sectional view of an alternate configuration of the blank of FIG. 2 or FIG. 4.

FIGS. 7A and 7B show alternative configurations of the insert 14 and the shell 20 forming the blank 10, where the interface 19 and the outer surface 29, in the cross-sectional view shown, are of varying shapes to provide thinner and thicker areas of aluminum which may be oriented or configured to coincide with certain features of the wheel 30 formed therefrom. For example, the thinner portions of aluminum in the blank 10 shown in FIG. 7A may coincide with the rim sections between the spokes of the wheel 30 (see FIG. 5A) to provide a higher magnesium to aluminum content in these areas, for added strength and reduced weight.

The forging, the blank, and the method of forming described herein are illustrated using an example of a vehicle wheel as the forged component. The example of a vehicle wheel shown in FIGS. 1-7B is intended to be non-limiting. The forging, blank, and the method of forming described herein may be configured to provide other components where a bimetal structure is advantageous, for example, to provide a high strength to weight ratio, or a surface structure differentiated from the core structure for corrosion protection, resistance to thermal shock, or other functional, appearance, or performance characteristics and features. Vehicle related examples include steering knuckles, connecting rods and engine supports, although it would be understood that the blank and method of forming and forging described herein would be useful for non-vehicular components and applications. Material combinations other than aluminum-based and magnesium-based materials may be possible using the methods described herein.

A forging blank and/or forged component produced by a method as described herein may be modified by additional processing and/or secondary treatment to enhance, optimize and/or develop certain characteristics and/or features. Non-limiting examples of additional processing and/or secondary treatments which may be applied or used to meet dimensional, appearance, function and/or performance requirements and specifications include machining, burnishing, polishing, pressing, forging, heat treating, anodizing, localized surface treatment such as peening, laser treatment, friction stir welding, friction mixing, etc., or a combination thereof.

While the best modes for carrying out the invention have been described in detail, those familiar with the art to which this invention relates will recognize various alternative designs and embodiments for practicing the invention within the scope of the appended claims.

The invention claimed is:

1. A method of forming a bimetallic forging, the method comprising:
- providing a first element substantially made of a first metal;
- providing a second element substantially made of the first metal;
- providing an insert substantially made of a second metal;
- forming a blank comprised of the first element, the second element, and the insert portion;
- wherein the blank is configured such that:
  - the insert is substantially encapsulated by a shell defined by the first element and the second element;
- joining the first element and the second element by friction stir welding to form a seam defined by a fine grained microstructure such that the seam is characterized by a higher fatigue strength relative to the remainder of the shell; and
- forging the blank to form a forging comprising:
  - an outer portion substantially made of the first metal and defined by the shell;
  - an inner portion substantially made of the second metal and defined by the insert; and
  - an interface layer defining a metallurgical bond between the outer portion and the inner portion.

2. The method of claim 1,
- wherein the first metal is one of aluminum and an aluminum alloy; and
- wherein the second metal is one of magnesium and a magnesium alloy.

3. The method of claim 1, further comprising:
- providing a third element made of the first metal;
- forming a blank comprised of the first element, the second element, the third element and the insert;
- wherein the shell of the blank is defined by the first element, the second element and the third element.

4. The method of claim 1,
- wherein the insert defines an outer surface;
- wherein the first element and the second element each define an inner surface;
- wherein at least one of the outer surface of the insert and the inner surfaces of the first and the second elements comprise a coating substantially comprised of a third metal.

5. The method of claim 1, wherein the forging is adaptable for use as a wheel for a vehicle.

6. The method of claim 1, further comprising at least one of:

wherein the insert is configured as a casting; and wherein at least one of the first element and the second element is configured as an extrusion.

7. A bimetallic forging formed from a blank, the forging comprising:

an outer portion substantially made of a first metal and defined by a shell portion of the blank;

wherein the shell portion includes a first element and a second element joined by a seam defined by a fine grained microstructure;

wherein the seam is characterized by a higher fatigue strength relative to the remainder of the shell portion;

an inner portion substantially made of a second metal and defined by an insert portion of the blank; and an interface layer defining a metallurgical bond between the outer portion and the inner portion.

8. The bimetallic forging of claim 7, wherein the first metal is one of aluminum and an aluminum alloy; and wherein the second metal is one of magnesium and a magnesium alloy.

9. The bimetallic forging of claim 7, wherein the outer portion is configured to substantially encapsulate the inner portion; and the outer portion is of non-uniform thickness.

10. The bimetallic forging of claim 7, wherein:

the interface layer includes a coating substantially made of a third metal; and the interface layer is defined by an intermetallic layer comprising the third metal and at least one of the first metal and the second metal.

11. The bimetallic forging of claim 7, wherein the forging is configured as a wheel for a vehicle.

12. The bimetallic forging of claim 7, wherein:

the shell portion further comprises a third element; and the third element is joined to one of the first element and the second element.

13. The bimetallic forging of claim 7, wherein the insert portion is non-concentric to the shell portion.

14. The bimetallic forging of claim 7, wherein the insert portion is non-symmetrical to the shell portion.

15. The bimetallic forging of claim 7, further comprising:

a polygonal interface between the insert portion and the shell portion; and a cylindrical outer surface defined by the shell portion.

16. The bimetallic forging of claim 7, further comprising:

a coating substantially made of one of graphite and boron nitride and applied to one of an outer surface of the insert portion and an interior surface of at least one of the first and second elements;

wherein the outer surface and the interior surface are interfacing surfaces.

* * * * *